US009247771B2

(12) United States Patent
Fiebelkorn

(10) Patent No.: US 9,247,771 B2
(45) Date of Patent: Feb. 2, 2016

(54) SMOKING ARTICLE

(71) Applicant: BRITISH AMERICAN TOBACCO (INVESTMENTS) LIMITED, London (GB)

(72) Inventor: Richard Fiebelkorn, London (GB)

(73) Assignee: BRITISH AMERICAN TOBACCO (INVESTMENTS) LIMITED (GB)

( * ) Notice: Subject to any disclaimer, the term of this patent is extended or adjusted under 35 U.S.C. 154(b) by 0 days.

(21) Appl. No.: 14/357,184

(22) PCT Filed: Oct. 25, 2012

(86) PCT No.: PCT/EP2012/071170
§ 371 (c)(1),
(2) Date: May 8, 2014

(87) PCT Pub. No.: WO2013/068240
PCT Pub. Date: May 16, 2013

(65) Prior Publication Data

US 2014/0299144 A1 Oct. 9, 2014

(30) Foreign Application Priority Data

Nov. 8, 2011 (GB) ..... 1119244.0

(51) Int. Cl.
*A24D 3/04* (2006.01)
*A24D 1/02* (2006.01)

(52) U.S. Cl.
CPC ..... *A24D 3/043* (2013.01); *A24D 1/025* (2013.01); *A24D 1/027* (2013.01); *A24D 3/04* (2013.01)

(58) Field of Classification Search
CPC ..... A24D 3/043; A24D 1/025; A24D 3/04
USPC ..... 131/336
See application file for complete search history.

(56) References Cited

U.S. PATENT DOCUMENTS 3,805,799 A 4/1974 Stewart, Jr. et al.
3,924,643 A * 12/1975 Summers ..... 131/336
(Continued)

FOREIGN PATENT DOCUMENTS

DE 3801718 A1 8/1988
EP 0386884 A2 9/1990
(Continued)

OTHER PUBLICATIONS

International Search Report and Written Opinion, mailed Mar. 6, 2013 for PCT/EP2012/071170, filed Oct. 25, 2012.
(Continued)

*Primary Examiner* — Anthony Calandra
(74) *Attorney, Agent, or Firm* — Cantor Colburn LLP

(57) ABSTRACT

A smoking article has a tobacco rod wrapped within a wrapping material and having first and second ends, a filter rod and ventilation, wherein the filter rod is connected to the first end of the tobacco rod by a tipping material partially overlapping the tobacco rod and at least partially overlapping the filter rod, and wherein the wrapping material is provided with a first region having a first permeability and/or porosity, the first region extending longitudinally along the tobacco rod from an intermediate position along the portion of the tobacco rod which is not overlapped by the tipping material towards the tipping material and with a second region having a second porosity and/or permeability higher than the first porosity and/or permeability, the second region extending longitudinally along the tobacco rod from the intermediate position towards the second end of the tobacco rod.

21 Claims, 3 Drawing Sheets

(56) References Cited

U.S. PATENT DOCUMENTS

| | | | | |
|---|---|---|---|---|
| 4,387,728 | A | 6/1983 | Reynolds et al. | |
| 4,607,647 | A * | 8/1986 | Dashley et al. | 131/365 |
| 7,926,324 | B2 | 4/2011 | Kida | |
| 2011/0232661 | A1 * | 9/2011 | Fiebelkorn | 131/280 |
| 2013/0118510 | A1 * | 5/2013 | Kaljura | A24D 1/025 131/280 |

FOREIGN PATENT DOCUMENTS

| | | | |
|---|---|---|---|
| EP | 0649606 | A1 | 4/1995 |
| GB | 1420908 | A | 1/1976 |
| JP | S61-28392 | A | 6/1984 |
| JP | 2009501540 | A | 1/2009 |
| WO | 98/07338 | A1 | 2/1998 |
| WO | 2004/014161 | A1 | 2/2004 |
| WO | 2005/082180 | A2 | 9/2005 |
| WO | 2007/010249 | A1 | 1/2007 |
| WO | 2009/037304 | A1 | 3/2009 |
| WO | 2009077244 | A1 | 6/2009 |
| WO | 2010/043475 | A1 | 4/2010 |
| WO | WO 2011117106 | A1 * | 9/2011 |
| WO | 2011/120687 | A1 | 10/2011 |
| WO | 2011/131465 | A1 | 10/2011 |

OTHER PUBLICATIONS

International Preliminary Report on Patentability, mailed Nov. 11, 2013, for PCT/EP2012/071170, filed Oct. 25, 2012.

Browne, Colin L, "The Design of Cigarettes", Hoechst Celanese, http://legacy.library.ucsf.edu/tid/fxb76b00.pdf, Sep. 1990, pp. 1-126.

Office Action dated Jun. 2, 2015 for corresponding Japanese Patent Application No. 2014-537619 (citing JP59111161, JP2009501540 and previously submitted WO2011131465) (with Machine Translation into English).

* cited by examiner

SMOKING ARTICLE

CLAIM FOR PRIORITY

This application is the National Stage of International Application No. PCT/EP2012/071170, filed Oct. 25, 2012, which in turn claims priority to and benefit of British Patent Application No. GB1119244.0, filed Nov. 8, 2011. The entire contents of the aforementioned applications are herein expressly incorporated by reference.

The present invention relates to a smoking article.

As used herein, the term 'smoking article' includes smokeable products such as cigarettes, cigars and cigarillos whether based on tobacco, tobacco derivatives, expanded tobacco, reconstituted tobacco or tobacco substitutes and also other tobacco or nicotine based products such as heat-not-burn products. The smoking article may be provided with a filter for the gaseous flow drawn by the smoker.

Smoking articles such as cigarettes generally comprise a rod of smokable material such as tobacco which is wrapped in a paper wrapper (cigarette paper). A filter unit comprising one or more filter components may be joined to the wrapped tobacco rod using a tipping paper.

For a uniform composition of tobacco rod, the smoke that is delivered through the tobacco rod from the burning tobacco, for any given puffing regime, is determined by three main factors: the amount of air drawn in through the coal during puffing; the filtration of the smoke through the remaining unburnt part of the tobacco rod; and the speed of burn of the tobacco rod between puffs (smoulder rate). The smoke delivery from any single puff thus generally depends on the length of tobacco rod remaining, and for a standard puff volume taken from the end of the rod, can result in increased smoke delivery as the tobacco rod shortens.

In accordance with embodiments of the invention, there is provided a smoking article comprising a tobacco rod wrapped within a wrapping material and having first and second ends, a filter rod and ventilation into the filter rod, wherein the filter rod is connected to the first end of the tobacco rod by a tipping material partially overlapping the tobacco rod and at least partially overlapping the filter rod and wherein the wrapping material is provided with a first region having a first permeability and porosity, the first region extending longitudinally along the tobacco rod from an intermediate position along the portion of the tobacco rod which is not overlapped by the tipping material towards the tipping material and with a second region having a second porosity and/or permeability higher than the respective first porosity and/or permeability, the second region extending longitudinally along the tobacco rod from the intermediate position towards the second end of the tobacco rod.

The first region can comprise a patch of material circumscribing the tobacco rod and arranged between the tobacco rod and the wrapping material. The first region can also comprise a patch of material circumscribing the tobacco rod and the wrapping material. The patch can comprise a coating for lowering its porosity and/or permeability. The coating can comprise an alginate or starch coating.

The wrapping material can comprise a low porosity and/or permeability wrapping material modified to increase its porosity and/or permeability in the second region. The modification can comprise at least one of embossing of the wrapping material and perforation of the wrapping material.

The wrapping material can comprise a coating applied to the first region to decrease the porosity and/or permeability of the first region.

The ventilation can be provided by air drawn through the tipping material via at least one of one or more laser perforations in the tipping material, one or more mechanical perforations in the tipping material, one or more cut outs in the tipping material, embossing in the tipping material and providing a porous tipping material.

The ventilation can be provided by air drawn through a plug wrap material surrounding the filter rod, via at least one of one or more laser perforations in the plug wrap material, one or more mechanical perforations in the plug wrap material, one or more cut outs in the plug wrap material, embossing in the plug wrap material and providing a porous plug wrap material.

The ventilation can comprise greater than 30% ventilation, greater than 40%, greater than 50% and/or greater than 60% ventilation.

The smoking article can comprise a 6 mg or lower tar delivery product.

The first region can comprise a porosity of less than 10 Coresta Units, less than 5 Coresta Units, less than 4 Coresta Units, less than 3 Coresta Units and/or less than 2 Coresta Units.

The first region can comprise a length of 40% to 80% of the total length of the tobacco rod. The first region can extend longitudinally along the tobacco rod from an intermediate position along the portion of tobacco rod which is not overlapped by the tipping material towards the tipping material to a point in the range 1% to 40% of the total length of the tobacco rod from the filter rod.

Embodiments of the invention will now be described, by way of example, with reference to accompanying figures, in which.

Figure 1:
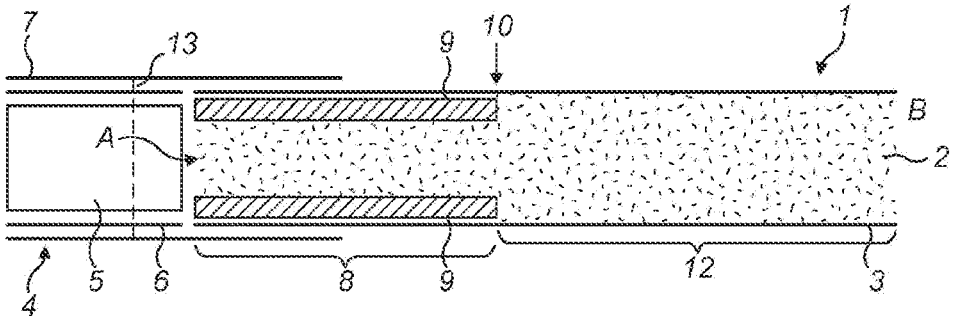
FIG. 1 is a cross-sectional view through a first smoking article having an internal patch at the filter end of a tobacco rod.

FIG. 1 is a cross-sectional view through the length of a first smoking article 1, in the present example a cigarette. The first smoking article 1 comprises a cylinder or rod of tobacco 2 that is encircled or encased in a wrapping material 3, in the present example cigarette paper, that forms a tube around the tobacco 2. A filter rod 4, comprising cellulose acetate fibres 5 wrapped in a plug wrap 6, is attached to the tobacco rod 2 using a tipping material 7, in the present example a tipping paper, which partially overlaps the tobacco rod 2 and in this example fully overlaps the filter rod 4. The tobacco rod 2 has a first end A to which the filter 4 is connected and a second end B which is intended to be lit.

The wrapping material 3 has a first region 8 including a patch 9 of material arranged between the tobacco rod 2 and the paper wrapper 3. The patch 9 surrounds the tobacco rod 2 and extends longitudinally along the tobacco rod 2 from an intermediate position 10 along the portion of the tobacco rod 2 which is not overlapped by the tipping material 7 towards the tipping material 7. In the present example, the patch 9 also extends further beyond the edge of the tipping material 7, underneath the tipping material 7 and wrapping material 3, to the first end A of the tobacco rod 2. In the illustrated example, the smoking article 1 is a king size format cigarette, having a circumference of 24.6 mm, a 27 mm long filter rod 4, a 56 mm long tobacco rod 2 and the tipping material 7 is 32 mm in length from the mouth end of the smoking article 1, overlapping the tobacco rod 2 by 5 mm. The intermediate position 10 is, in the present example, substantially at the midpoint of the tobacco rod 2 between the first and second ends A, B. In particular, in the illustrated example, the intermediate position 10 is 28 mm along the tobacco rod 2 from the first end A and the patch 9 extends 23 mm along the tobacco rod 2 from the edge of the tipping material 7.

The wrapping material 3 also has a second region 12 in which the tobacco rod 2 is not surrounded by the patch 9. The second region 12 extends longitudinally along the tobacco rod 2 from the intermediate position 10 towards the second end B of the tobacco rod 2. The second region 12 has a permeability to air such that, in use, air enters the first smoking article 1 through the wrapper 3 in this region 12 and also through the coal at the second end B of the tobacco rod 2 when a smoker draws on the lit smoking article 1, thus allowing the smoking article 1 to be smoked. In the present, illustrated example, the second region extends 28 mm along the tobacco rod 2.

The first smoking article 1 is ventilated, in the present example via ventilation channels 13 provided into the filter rod 4. The ventilation channels 13 are formed by online laser perforation into the tipping paper 7 and plug wrap 6, allowing external air to be drawn into the filter 4.

Due to the patch 9 provided in the first region 8 of the wrapping material 3, the second region 12 has a higher permeability than that of the first region 8. The first region 8, relative to the second region 12, restricts the amount of air entering into the tobacco rod 2 through the wrapping material in that region. Hence, as the first smoking article 1 is smoked and the coal reaches the portion of the tobacco rod 2 circumscribed by the patch 9, an increasingly restricted amount of external air will enter the tobacco rod 2. This has the effect of increasing the air drawn through the ventilation 13 and accordingly further diluting the smoke and therefore reducing the tar delivery of the first smoking article 1 compared to conventional smoking articles in the latter puffs. The velocity of air drawn through the coal at the second end B of the tobacco rod 2 may also be decreased. Furthermore, due to lowering the velocity of air drawn through the coal at the second end B of the tobacco rod 2 and/or the restricted amount of external air entering the tobacco rod 2, the smoke flow rate through the tobacco rod 2 is lower than it would otherwise be, enabling a higher level of filtration through uncombusted tobacco in the rod 2 and allowing more smoke constituents to diffuse out of the smoking article.

In one example the patch 9 is formed from paper having a permeability of approximately 25 Coresta Units (CU). For a wrapping material 3, for instance cigarette paper, having a permeability of 50 CU, this can, for instance, have the effect of reducing the permeability of the combined wrapping material 3 and patch 9 to between approximately 0 and 20 CU. Alternatively, the patch 9 can be formed from a paper having a coating for reducing its permeability, such as alginate or starch, reducing its permeability to between approximately 1 and 25 CU and the permeability of the combined wrapping material 3 and patch 9 to between approximately 0 and 20 CU.

The first smoking article 1 accordingly delivers smoke to a smoker with less variation between initial and final puffs, and accordingly mitigates an increase in delivery which may be observed in conventional cigarettes in the final puffs.

Figure 2:
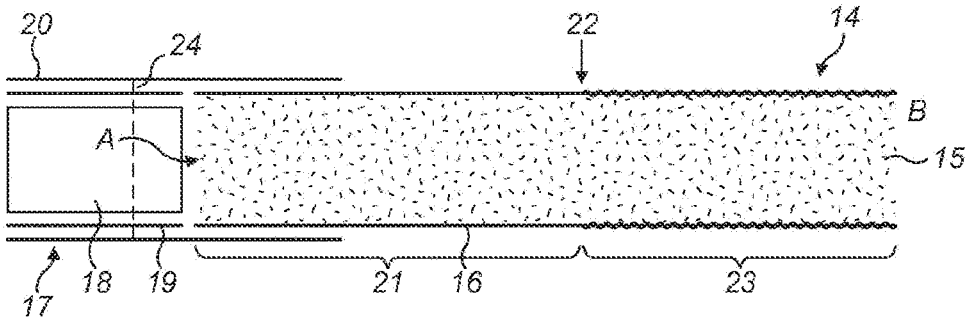
FIG. 2 is a cross-sectional view through a second smoking article having an embossed portion at the distal end of a tobacco rod.

FIG. 2 is a longitudinal cross-sectional view through a second smoking article 14. The second smoking article 14 is generally similar to the first smoking article 1. The second smoking article 14 comprises a cylinder or rod of tobacco 15 that is encircled or encased in a wrapping material 16, in the present example cigarette paper, that forms a tube around the tobacco 15. A filter rod 17, comprising cellulose acetate fibres 18 wrapped in a plug wrap 19, is attached to the tobacco rod 15 using a tipping material 20, in the present example a tipping paper, which partially overlaps the tobacco rod 15 and at least partially overlaps the filter rod 17. The tobacco rod 15 has a first end A to which the filter 17 is connected and a second end B which is intended to be lit.

The wrapping material 16 circumscribing the tobacco rod 15 is, in the present example, formed from a low permeability paper having a permeability of less than 40 CU, and preferably less than 10 CU or less than 5 CU. The wrapping material 16 has a first region 21 which is has not been modified to alter its propensity for air to pass through the material 16, in particular its permeability and/or porosity. The first region 21 extends longitudinally along the tobacco rod 15 from an intermediate position 22 along the portion of the tobacco rod 15 which is not overlapped by the tipping material 20 towards the tipping material 20. In the present example, the first region 21 also extends further beyond the edge of the tipping material 20 to the first end A of the tobacco rod 14. The intermediate position 22 is, in the present example, substantially at the midpoint of the tobacco rod 15 between the first and second ends A, B. The dimensions of the second smoking article 14 and the location of the intermediate position 22 are the same as those of the first smoking article 1.

The wrapping material 16 also includes a second region 23 which extends longitudinally along the tobacco rod 15 from the intermediate position 22 towards the second end B of the tobacco rod 15. The second region 23 has been modified to increase the propensity for air to pass through the material 16, for instance increasing the overall porosity and/or permeability of the material. In the present example, the material 16 has been modified to have a permeability to air such that, in use, air enters the second smoking article 14 through the wrapper 16 in this region 23 and also through the coal at the second end B of the tobacco rod 15 when a smoker draws on the lit smoking article 14, thus allowing the smoking article 14 to be smoked. In the present example, increased permeability and porosity of the second region 23 is achieved by embossing the wrapping material 16 in this region 23 using an embossing roller having pyramid shaped embossing protrusions extending therefrom, which have the effect of opening up fibres of the material in the second region. However, other forms of embossing or otherwise increasing the permeability and/or porosity of the wrapper in the second region 23 could be used.

The second smoking article 14 is ventilated, in the present example via ventilation channels 24 provided into the filter rod 17. The ventilation channels 24 are formed by online laser perforation into the tipping paper 20 and plug wrap 19, allowing external air to be drawn into the filter 17.

Similarly to the first smoking article, due to the low permeability provided in the first region 21 of the wrapping material 16, and the embossing used in the second region 23, the second region 23 has a higher permeability than that of the first region 21. The first region 21, relative to the second region 23, therefore restricts the amount of air entering into the tobacco rod 15 through the wrapping material in that region. Hence, as the second smoking article 14 is smoked and the coal reaches the portion of the tobacco rod 15 surrounded by the low permeability wrapping material 16, an increasingly restricted amount of external air will enter the tobacco rod 15. This has the effect of increasing the air drawn through the ventilation 24 and accordingly further diluting the smoke and therefore reducing the tar delivery of the second smoking article 14 compared to conventional smoking articles in the latter puffs. The velocity of air drawn through the coal at the second end B of the tobacco rod 15 may also be decreased. Furthermore, due to lowering the velocity of air drawn through the coal at the second end B of the tobacco rod 15 and/or the restricted amount of external air entering the tobacco rod 15, the smoke flow rate through the tobacco rod 15 is lower than it would otherwise be, enabling a higher level of filtration through uncombusted tobacco in the rod 15 and allowing more smoke constituents to diffuse out of the smoking article.

Figure 3:
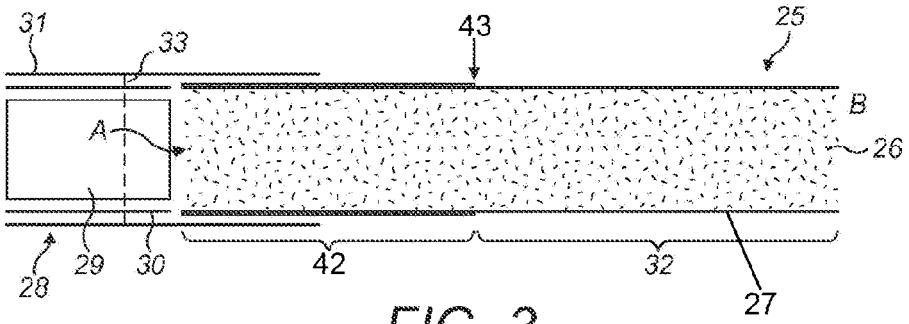
FIG. 3 is a cross-sectional view through a third smoking article having coating applied to a region at the filter end of a tobacco rod.

FIG. 3 is a longitudinal cross-sectional view through a third smoking article 25. The third smoking article 25 is generally similar to the first and second smoking articles 1, 14. The third smoking article 25 comprises a cylinder or rod of tobacco 26 that is encircled or encased in a wrapping material 27, in the present example cigarette paper, that forms a tube around the tobacco 26. A filter rod 28, comprising cellulose acetate fibres 29 wrapped in a plug wrap 30, is attached to the tobacco rod 26 using a tipping material 31, in the present example a tipping paper, which partially overlaps the tobacco rod 26 and in this example fully overlaps the filter rod 28. The tobacco rod 26 has a first end A to which the filter 28 is connected and a second end B which is intended to be lit.

The wrapping material 27 circumscribing the tobacco rod 26 has a first region 42 which is coated online using a coating for reducing its permeability. In the present example, the coating comprises an alginate. The first region 42 extends longitudinally along the tobacco rod 26 from an intermediate position 43 along the portion of the tobacco rod 26 which is not overlapped by the tipping material 31 towards the tipping material 31. In the present example, the first region 28 also extends further beyond the edge of the tipping material 31 to the first end A of the tobacco rod 26. The intermediate position 43 is, in the present example, substantially at the midpoint of the tobacco rod 26 between the first and second ends A, B. The dimensions of the third smoking article 25 and the location of the intermediate position 43 are the same as those of the first and second smoking articles 1,14.

The wrapping material 27 also includes a second region 32 which extends longitudinally along the tobacco rod 26 from the intermediate position 43 towards the second end B of the tobacco rod 26. The second region 32 has a permeability to air such that, in use, air enters the third smoking article 25 through the wrapper 27 in this region 32 and also through the coal at the second end B of the tobacco rod 26 when a smoker draws on the lit smoking article 25, thus allowing the smoking article 25 to be smoked.

The third smoking article 25 is ventilated, in the present example via ventilation channels 33 provided into the filter rod 28. The ventilation channels 33 are formed by online laser perforation into the tipping paper 31 and plug wrap 30, allowing external air to be drawn into the filter 28.

Similarly to the first and second smoking articles, due to the low permeability provided in the first region 28 of the wrapping material 27, the second region 32 has a higher permeability than that of the first region 28. The first region 28, relative to the second region 32, therefore restricts the amount of air entering into the tobacco rod 26 through the wrapping material in that region. Hence, as the third smoking article 25 is smoked and the coal reaches the portion of the tobacco rod 26 surrounded by the coated wrapping material 27, an increasingly restricted amount of external air will enter the tobacco rod 26. As with the first and second smoking articles, this has the effect of increasing the air drawn through the ventilation 33 and accordingly further diluting the smoke and therefore reducing the tar delivery of the third smoking article 25 compared to conventional smoking articles in the latter puffs. The velocity of air drawn through the coal at the second end B of the tobacco rod 26 may also be decreased. Furthermore, due to lowering the velocity of air drawn through the coal at the second end B of the tobacco rod 26 and/or the restricted amount of external air entering the tobacco rod 26, the smoke flow rate through the tobacco rod 26 is lower than it would otherwise be, enabling a higher level of filtration through uncombusted tobacco in the rod 26 and allowing more smoke constituents to diffuse out of the smoking article.

Figure 4:
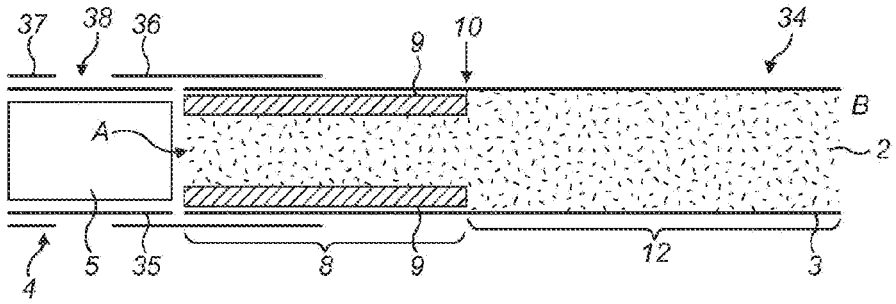
FIG. 4 is a cross-sectional view through a fourth smoking article having an internal patch at the filter end of a tobacco rod and an arrangement whereby tipping material does not extend continuously to the mouth-end of the smoking article.

FIG. 4 is a cross-sectional view through the length of a fourth smoking article 34, in this example a cigarette. The fourth smoking article 34 is the same as the first smoking article 1 except in relation to the plug wrap and tipping paper.

Accordingly, other components of the fourth smoking article 34 have been given the same reference numerals as those of the first smoking article 1 and the corresponding description of such components as set out above applies.

In the fourth smoking article 34, the filter rod 4 comprises cellulose acetate fibres 5 wrapped in a permeable plug wrap 35, and attached to the tobacco rod 2 using a first tipping material section 36, in the present example a tipping paper, which partially overlaps the tobacco rod 2 and only partially overlaps the filter rod 4. A second tipping material section 37, in the present example also a tipping paper, circumscribes the mouth-end of the filter rod 4, leaving a region of the permeable plug wrap 35 in between the first and second tipping material sections 36, 37, exposed. In the illustrated example of the fourth smoking article 34, the first tipping material section 36 is 10 mm in length, overlapping each of the tobacco rod 2 and filter rod 4 by 5 mm. The second tipping material section 37 is 5 mm in length, leaving a region of length 17 mm of permeable plug wrap 35 exposed.

The fourth smoking article 34 is therefore ventilated via the permeable plug wrap 35 in a region of the plug wrap 35 which is not covered by tipping material 36, 37. Ventilation in this manner has the advantage of providing a more consistent percentage ventilation as the flow rate of air and smoke through the filter rod 4 increases, when compared to other forms of ventilation such as laser ventilation. As before, as the fourth smoking article 34 is smoked and the coal reaches the portion of the tobacco rod 2 circumscribed by the patch 9, an increasingly restricted amount of external air will enter the tobacco rod 2. This has the effect of increasing the air drawn through the permeable plug wrap 35. However, whereas laser ventilation can provide a reduced percentage of ventilation for increased flow rate, this reduction is minimised by the use of ventilation through a permeable plug wrap 35 and accordingly the smoke and therefore tar delivery of the fourth smoking article 34 are diluted further compared to conventional smoking articles in the latter puffs. Furthermore, smoke constituents can diffuse out of the filter via the permeable plug wrap, for instance between puffs.

Figure 5:
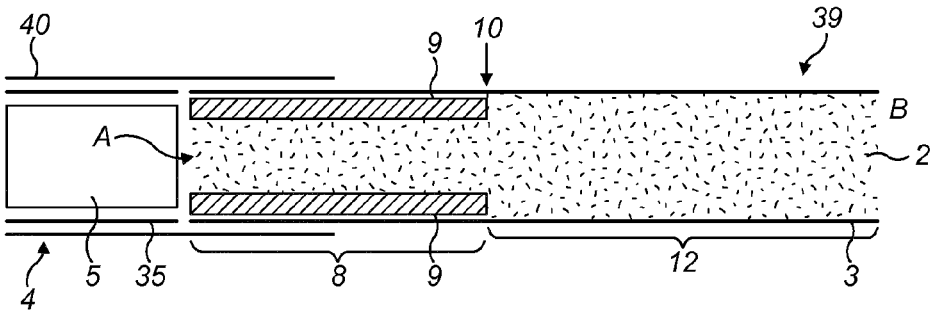
FIG. 5 is a cross-sectional view through a fifth smoking article having an internal patch at the filter end of a tobacco rod and a porous plug wrap and tipping paper.

FIG. 5 is a cross-sectional view through the length of a fifth smoking article 39. The fifth smoking article 39 is the same as the fourth smoking articles 34 except in relation to the tipping paper. Accordingly, other components of the fifth smoking article 39 have been given the same reference numerals as those of the fourth smoking article 34 and the corresponding description of such components as set out above applies.

In the fifth smoking article 39, the filter rod 4 comprises cellulose acetate fibres 5 wrapped in a permeable plug wrap 35, and attached to the tobacco rod 2 using a permeable tipping material 40, which partially overlaps the tobacco rod 2 and fully overlaps the filter rod 4.

The fifth smoking article 39 is therefore ventilated via the permeable plug wrap 35 and the permeable tipping material 40. Ventilation in this manner, similarly to the fourth smoking article 34, has the advantage of providing a more consistent percentage ventilation as the flow rate of air and smoke through the filter rod 4 increases, when compared to other forms of ventilation such as laser ventilation. Furthermore, smoke constituents can diffuse out of the filter via the permeable plug wrap and tipping, for instance between puffs.

The first to fifth smoking articles 1, 14, 25, 34 and 39 are relatively low tar delivery cigarettes, having a delivery of 5 mg. The smoking articles may alternatively have a higher or lower delivery, for instance less than 6 mg, less than 5 mg or less than 4 mg.

Smoking articles as described herein mitigate against an increase in tar delivery which may otherwise occur in later puffs. Furthermore, due to the low permeabilities of the portions of the wrapping materials at the filter end of the tobacco rods, the smoking articles are generally compliant with low ignition propensity requirements.

Although specific examples have been described, advantageous effects can be realised without being limited to these specific examples. For instance, the smoking articles have been described as having lower permeability regions that extend from the mouth end B of the smoking article substantially to the midpoint of the tobacco rods. However, other lengths of low permeability region may be used. The length can be chosen to select any desired ratio between the portion of decreased smoke delivery and the portion of substantially unaltered smoke delivery. Lengths between 10% and 90% of the total length of the tobacco rod have been found to be useful, for example lengths in the range 40% to 80%, 45% to 65%, 55% to 65% or approximately 60%.

Also, the region of lower permeability need not extend all the way to the filter rod end of the tobacco rod, or to the edge of tipping material. A low permeability region that terminates short of the tipping material can still provide the above-described effects. For example, the low permeability region may extend from an intermediate upstream point or position along the tobacco rod to a point in the range 1% to 40% of the total length of the tobacco rod from the filter end.

To provide the maximum smoke delivery modification effect for a given length of lower permeability region, the lower permeability region should preferably extend around the full circumference of the tobacco rod, although it need not extend around the full circumference to achieve some of the effects. The low permeability region may include one or more separate regions spaced radially around the circumference of a tobacco rod, for instance evenly spaced for symmetrical combustion.

The patch, if used, can be fabricated from any material that has appropriate combustion and compositional properties for inclusion in a smoking article and which provides the required low permeability. Materials which inherently have the desired structure can be used, such as a fibrous sheet material. The fibrous sheet material may be cellulosic sheet material or tobacco-containing sheet material such as reconstituted tobacco sheet material or tobacco substitute sheet material, for example. Alternatively, materials can be specifically fabricated so as to have a suitable structure. For example, a foamed material can be used. Examples of suitable foamed materials are extruded tobacco reconstituted materials and foamed band-cast tobacco sheet.

The patch, although described as being located between the wrapper and the tobacco rod, can be applied outside the wrapper.

The patch and/or cigarette paper or other material used in the examples described herein and in other embodiments of the invention are selected such that the second region of the tobacco rod wrapper has a higher respective permeability and/or porosity than the first region of the tobacco rod wrapper. This may be achieved in the manner described herein and also using other methods.

The selected materials for the patch and/or cigarette paper or other material used in the examples described herein may have a dry basis weight in the range 20 to 60 gsm, or 35 to 45 gsm. The thickness of the material may be in the range 60 to 150 microns, or 80 to 120 microns. However, other ranges of basis weight and thickness can be used.

Although specific examples of the use of laser ventilation or naturally permeable plug wraps and tipping papers have been described, other forms of ventilation can be used, such as mechanical perforation, electrostatic perforation, or providing permeable and/or porous plug wraps or tipping papers using other techniques such as embossing or micro-perforation.

EXAMPLE

A cigarette was produced generally according to the first smoking article as illustrated in FIG. 1. An 83 mm long smoking article having a circumference of 24.6 mm in king size format was used, with a tobacco rod 56 mm long and a filter rod 27 mm in length. Tipping having a length of 32 mm was used to connect the filter rod and tobacco rod. A coated paper patch was applied between the tobacco rod and cigarette paper extending 34 mm from the filter end of the tobacco rod towards the end of the tobacco rod to be lit, having an alginate coating. Laser ventilation was used to provide the filter with 80% ventilation.

Figure 6:
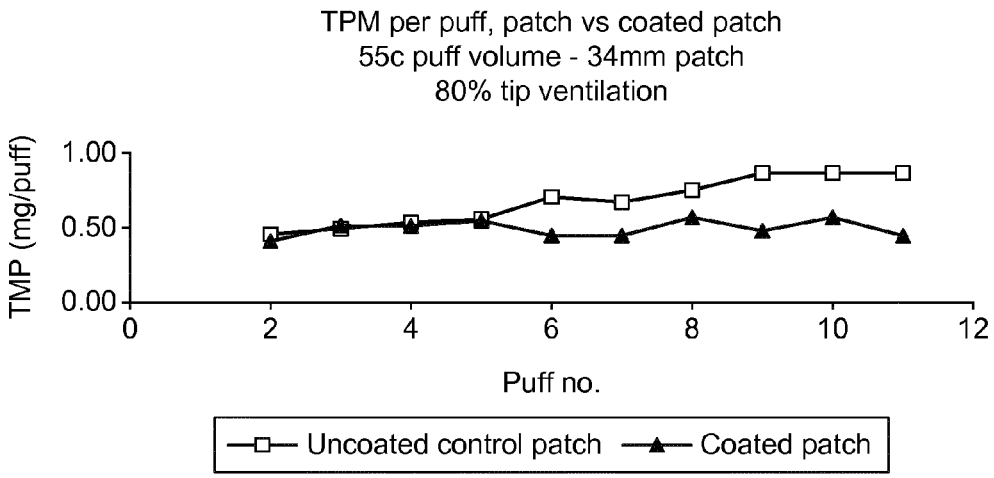
FIG. 6 is a graph illustrating the total particular matter delivery of a smoking article having an internal coated patch when compared to a control smoking article having an uncoated patch.

The cigarette of Example 1 was machine smoked under standard conditions, with a 55 cc puff volume with 2 second duration at 30 second intervals. FIG. 6 is a graph illustrating the total particular matter delivered for each puff, as compared to a control cigarette having the same specifications and with the same paper patch but without the alginate coating. As illustrated, the delivery per puff in the later puffs when the coated patch was used was significantly reduced, compared to the control.

In order to address various issues and advance the art, the entirety of this disclosure shows by way of illustration various embodiments in which the claimed invention(s) may be practiced and provide for superior smoking articles. The advantages and features of the disclosure are of a representative sample of embodiments only, and are not exhaustive and/or exclusive. They are presented only to assist in understanding and teach the claimed principles. It should be understood that they are not representative of all claimed inventions. As such, certain aspects of the disclosure have not been discussed herein. That alternate embodiments may not have been presented for a specific portion of the invention or that further undescribed alternate embodiments may be available for a portion is not to be considered a disclaimer of those alternate embodiments. It will be appreciated that many of those undescribed embodiments incorporate the same principles of the invention and others are equivalent. Thus, it is to be understood that other embodiments may be utilized and modifications may be made without departing from the scope and/or spirit of the disclosure. As such, all examples, implementations, and/or embodiments are deemed to be non-limiting throughout this disclosure. Also, no inference should be drawn regarding those embodiments discussed herein relative to those not discussed herein other than it is as such for purposes of reducing space and repetition. Various embodiments may suitably comprise, consist of, or consist essentially of, various combinations of the disclosed elements, components, features, parts, steps, means, etc. Some of the disclosed features, elements, implementation, etc., may be mutually contradictory, in that they cannot be simultaneously present in a single embodiment. Similarly, some features are applicable to one aspect of the disclosure, and inapplicable to others. In addition, the disclosure includes other inventions not presently claimed. Applicant reserves all rights in those presently unclaimed inventions including the right to claim such inventions, file additional applications, continuations, continuations in part, divisions, and/or the like thereof. As such, it should be understood that advantages, embodiments, examples, functional, features, structural, and/or other aspects of the disclosure are not to be considered limitations on the disclosure as defined by the claims or limitations on equivalents to the claims.

The invention claimed is:

1. A smoking article comprising:

a tobacco rod wrapped within a wrapping material and having a first end and a second end;

a filter rod; and a porous plug wrap material, configured to supply ventilation into the filter rod, covering the lateral surface of the filter rod, the filter rod connected to the first end of the tobacco rod by a tipping material partially overlapping the tobacco rod and at least partially overlapping the filter rod, the wrapping material provided with a first region having a first permeability and porosity, the first region extending longitudinally along the tobacco rod from an intermediate position along the portion of tobacco rod which is not overlapped by the tipping material towards the tipping material and with a second region having a porosity higher than the porosity of the first region and/or a permeability higher than the permeability of the first region, the second region extending longitudinally along the tobacco rod from the intermediate position towards the second end of the tobacco rod, and the first region being formed from a web of material having a permeability of less than 40 Coresta units, and the first region having a length in the range 40% to 80% of a total length of the tobacco rod.

2. The smoking article according to claim 1, wherein the first region comprises a patch of material circumscribing the tobacco rod and arranged between the tobacco rod and the wrapping material.

3. The smoking article according to claim 1, wherein the first region comprises a patch of material circumscribing the tobacco rod and the wrapping material.

4. The smoking article according to claim 2, wherein the patch comprises a coating configured to lower the porosity of the patch and/or the permeability of the patch.

5. The smoking article according to claim 4, wherein the coating comprises an alginate or a starch.

6. The smoking article according to claim 1, wherein the wrapping material exhibits low porosity and/or low permeability, and is modified to increase porosity in the second region and/or permeability in the second region.

7. The smoking article according to claim 6, wherein the second region of the wrapping material comprises at least one of embossed wrapping material and perforated wrapping material.

8. The smoking article according to claim 1, wherein the first region comprises a coating configured to decrease porosity of the first region and/or permeability of the first region.

9. The smoking article according to claim 1, wherein the tipping material is configured to provide ventilation to the smoking article via at least one of:

one or more laser perforations;

one or more mechanical perforations;

one or more cut outs;

embossing; and a porous tipping material.

10. The smoking article according to claim 1, wherein the smoking article is configured to provide greater than 30% ventilation.

11. The smoking article according to claim 1, wherein the smoking article is configured to provide non-zero tar delivery of 6 mg or less.

12. The smoking article according to claim 1, wherein the first region comprises a permeability of less than 10 Coresta Units.

13. The smoking article according to claim 1, wherein the first region extends longitudinally along the tobacco rod from the intermediate position, along a portion of the tobacco rod which is not overlapped by the tipping material, towards the tipping material to a point that is between 1% and 40% of the total length of the tobacco rod from the filter rod.

14. The smoking article according to claim 3, wherein the patch comprises a coating configured to lower the porosity of the patch and/or the permeability of the patch.

15. The smoking article according to claim 12, wherein the first region comprises a permeability of less than 5 Coresta Units.

16. The smoking article according to claim 12, wherein the first region comprises a permeability of less than 4 Coresta Units.

17. The smoking article according to claim 12, wherein the first region comprises a permeability of less than 3 Coresta Units.

18. The smoking article according to claim 12, wherein the first region comprises a permeability of less than 2 Coresta Units.

19. The smoking article according to claim 1, configured to provide greater than 40% ventilation.

20. The smoking article according to claim 1, configured to provide greater than 50% ventilation.

21. The smoking article according to claim 1, configured to provide greater than 60% ventilation.

* * * * *